US008464362B2

(12) United States Patent
Hersick

(10) Patent No.: US 8,464,362 B2
(45) Date of Patent: Jun. 18, 2013

(54) PROTECTIVE HELMETS AND METHOD OF MANUFACTURE THEREOF

(75) Inventor: F. Joseph Hersick, Zelienople, PA (US)

(73) Assignee: Mine Safety Appliances Company, Cranberry Township, PA (US)

( * ) Notice: Subject to any disclaimer, the term of this patent is extended or adjusted under 35 U.S.C. 154(b) by 982 days.

(21) Appl. No.: 10/916,831

(22) Filed: Aug. 13, 2004

(65) Prior Publication Data

US 2006/0031975 A1 Feb. 16, 2006

(51) Int. Cl.
*A42B 3/04* (2006.01)
*A42B 3/00* (2006.01)

(52) U.S. Cl.
USPC ..... 2/5; 2/410; 2/7; 2/8.1; 2/175.1; 2/175.2

(58) Field of Classification Search
USPC ..... 2/411, 412, 410, 175.1–175.5, 75.2, 2/195.5, 195.6, 5, 7, 8, 12, 8.1, 8.2, 205, 2/209.12, 195.1, 200.1, 259, 10; 223/17
See application file for complete search history.

(56) References Cited

U.S. PATENT DOCUMENTS 288,596 A * 11/1883 Ryder ..... 2/204
354,882 A * 12/1886 Bracher ..... 2/175.2
381,666 A * 4/1888 Anderson ..... 2/5
560,213 A * 5/1896 Hopkins ..... 2/5
1,005,682 A * 10/1911 Bendel ..... 2/175.2
1,457,826 A * 6/1923 Egerton ..... 156/221
1,558,142 A * 10/1925 Brenner ..... 2/181
1,875,143 A * 8/1932 Punton ..... 2/412
2,025,772 A * 12/1935 Punton ..... 2/5
2,239,946 A * 4/1941 Upchurch, Jr. ..... 2/413
2,306,362 A * 12/1942 Wolff ..... 2/5
2,384,183 A * 9/1945 Ludwell ..... 2/418
2,421,427 A * 6/1947 Mamlin et al. ..... 2/5
2,445,230 A * 7/1948 Mattsson et al. ..... 2/209.3
2,601,149 A * 6/1952 Jamison, Jr. ..... 2/5
2,663,874 A * 12/1953 Lyon ..... 2/173.5
2,692,388 A * 10/1954 Libshutz et al. ..... 2/181
3,087,165 A * 4/1963 Cairns ..... 2/418
3,100,896 A * 8/1963 Khanbegian ..... 2/5
3,703,750 A * 11/1972 Irwin, Jr. ..... 24/265 R
3,845,389 A * 10/1974 Phillips et al. ..... 455/90.3
3,992,721 A * 11/1976 Morton ..... 2/414
3,994,023 A * 11/1976 Aileo et al. ..... 2/417
4,020,507 A * 5/1977 Morton ..... 2/411
4,106,127 A * 8/1978 Marangoni et al. ..... 2/416
4,619,003 A * 10/1986 Asbury ..... 2/5
4,656,667 A * 4/1987 Blake ..... 2/5
RE32,569 E * 1/1988 Aileo et al. ..... 2/416
4,766,609 A * 8/1988 Lane ..... 2/5
5,018,220 A * 5/1991 Lane et al. ..... 2/5
5,044,016 A * 9/1991 Coombs ..... 2/414

(Continued)

*Primary Examiner* — Bobby Muromoto, Jr.
(74) *Attorney, Agent, or Firm* — James G. Uber, Esquire; Mine Safety Appliances Company

(57) ABSTRACT

A protective helmet includes an outer shell having a generally dome-shaped section and a brim extending outwardly from the dome-shaped section. The dome-shaped section and the brim are formed from a thermoplastic material. The helmet further includes a brim support in operative connection with at least a portion of the brim. The brim support is formed from a material that is more heat resistant than the thermoplastic material. The brim support is sufficiently rigid to limit deformation of the brim upon exposure to high temperature. The brim support material can, for example, have a melting point above 500° F.

28 Claims, 8 Drawing Sheets

U.S. PATENT DOCUMENTS 5,071,608 A * 12/1991 Smith et al. ..... 264/119
5,113,534 A * 5/1992 Lane et al. ..... 2/416
5,117,506 A * 6/1992 Byrnes et al. ..... 2/10
5,150,479 A * 9/1992 Oleson ..... 2/414
5,329,637 A * 7/1994 Walker ..... 2/5
5,517,691 A * 5/1996 Blake ..... 2/5
5,774,900 A * 7/1998 Wu et al. ..... 2/411
6,041,435 A * 3/2000 Paulson et al. ..... 2/10
6,098,197 A * 8/2000 Hetzel et al. ..... 2/5
6,151,712 A * 11/2000 Lampi ..... 2/10
6,260,212 B1 * 7/2001 Orotelli et al. ..... 2/410
6,317,895 B1 * 11/2001 Erth et al. ..... 2/411
6,317,896 B1 * 11/2001 Timms et al. ..... 2/417
6,609,913 B1 * 8/2003 Batts ..... 434/226
6,817,039 B1 * 11/2004 Grilliot et al. ..... 2/413
6,880,176 B2 * 4/2005 Timms et al. ..... 2/425
6,892,725 B2 * 5/2005 Frund ..... 128/201.29
6,961,963 B2 * 11/2005 Rosie ..... 2/171.3
6,969,478 B1 * 11/2005 Hetzel, Jr. ..... 264/137
7,089,603 B2 * 8/2006 Ketterer et al. ..... 2/418
7,110,743 B2 * 9/2006 Depew et al. ..... 455/404.1
2001/0051692 A1 * 12/2001 Kanamori et al. ..... 525/411
2002/0127361 A1 * 9/2002 Sandt et al. ..... 428/40.1
2002/0177643 A1 * 11/2002 Dobler et al. ..... 524/392
2004/0093658 A1 * 5/2004 Jackson ..... 2/195.1
2004/0136769 A1 * 7/2004 Ferrara ..... 401/6
2004/0143088 A1 * 7/2004 Kratschmer et al. ..... 528/199
2004/0158025 A1 * 8/2004 Bruder et al. ..... 528/176
2004/0186233 A1 * 9/2004 Moethrath et al. ..... 525/79
2004/0256770 A1 * 12/2004 Padgett et al. ..... 264/544
2005/0015855 A1 * 1/2005 Skiba ..... 2/412
2005/0028253 A1 * 2/2005 Fowler ..... 2/411
2005/0262616 A1 * 12/2005 Padgett et al. ..... 2/410
2006/0005291 A1 * 1/2006 Bedford ..... 2/7
2006/0026742 A1 * 2/2006 Lang-Ree et al. ..... 2/412
2006/0031975 A1 * 2/2006 Hersick ..... 2/5

* cited by examiner

PROTECTIVE HELMETS AND METHOD OF MANUFACTURE THEREOF

FIELD OF THE INVENTION

The present invention relates generally to protective helmets and to methods of manufacture thereof, and, particularly, to thermoplastic protective helmets for use by firefighters and to methods of manufacture thereof.

BACKGROUND OF THE INVENTION

The outer, protective garments worn by firefighters (commonly referred to as turnout gear) typically include a large coat and pants that have three layers: (1) an outer layer, (2) a intermediate layer providing a vapor barrier, and (3) a removable inner layer providing thermal insulation. The outer layer is fabricated from materials that are resistant to heat, flame, abrasion and water. Firefighters also wear other protective gear, including a helmet, thick gloves, and an air tank that is typically part of a self-contained breathing apparatus (SCBA).

In the 19$^{th}$ century, firefighters in the United States commonly used leather helmets which included a long rear brim and curled up side brims to prevent water from running down the firefighter's neck and into his coat. Around the beginning of the 20$^{th}$ century, firefighters started using aluminum helmets which were molded to look like leather helmets but were less expensive. However, aluminum helmets conducted heat and electricity, causing many firefighters to return to using leather helmets. Leather helmets, which are still popular among firefighters today, are strong enough to provide protection from falling objects, and the large brim of the traditional leather helmets sheds water effectively and prevents objects from dropping down the back of the fire fighter's neck. Leather helmets, however, are very labor intensive and time consuming to manufacture, making them relatively more expensive.

Designers of firefighter helmets must consider a wide array of factors, including, for example, heat, and flame resistance; resistance to electrical current; impact force and acceleration; penetration; chin strap and suspension system effectiveness; flammability and resistance of ear covers; resistance of the face shield to heat and flame; and brightness and surface area of fluorescent markings. In the 1970s, the National Fire Protection Association (NFPA) developed its Standard on Structural Fire Fighter's Helmets. NFPA certification requires that firefighter helmets meet a number of stringent performance requirements.

Modern firefighter helmets are often fabricated from high-tech plastic and composite materials. Such helmets often include a suspension system and energy-absorbing foam impact liners, a face shield and flame-resistant flaps. To satisfy the NFPA standard, firefighter helmets are usually fabricated from highly impact resistant and thermally stable materials such as thermoplastics (for example, a polyetherimide) and thermosets (for example, fiberglass composites including vinylester/polyester thermoset resins). For example, CairnsHELMETS® 1000 and CAIRNS® 1010 helmets, available from Mine Safety Appliances Company ("MSA"), are NFPA approved helmets fabricated from fiberglass composites, which can be reinforced with ballistic-grade KEVLAR® (poly(p-phenyleneterephtalamide, available from Dupont of Wilmington, Del.). Similarly, the CairnsHELMETS® PHOENIX® 660 helmet, available from MSA, is an NFPA approved helmet fabricated from a thermoplastic material.

Thermoplastic helmets, however, have generally been limited to a "modern" or jet-fighter pilot" helmet design in which the helmet brim extends out from the helmet to a much lesser extent and at a greater downward angle relative to horizontal than the brims of a "traditional" helmet design. Prior to the present invention, it was not possible to produce thermoplastic helmets having the extending brim of the traditional helmet design (which typically extends away from the helmet dome by at least 2.5 in. (and, more typically, by at least 3 in.) at, for example, the rear of the helmet) to fully satisfy the NFPA 1971 standard, the disclosure of which is incorporated herein by reference. In that regard, such helmets (and particularly the brims thereof) often do not satisfy the current version of the NFPA 1971 standard for resistance to heat, which limits the deformation a helmet can exhibit under extended exposure to highly elevated temperatures (that is, 5 minutes at a temperature of 500° F.; see, for example, paragraphs 5-2.4, 6-6.2 through 6-6.7 and 6-6.12 of the current version of the NFPA 1971 standard).

However, many firefighters prefer to use helmets having a traditional design. In part, such firefighters prefer the traditional look of such helmets. Moreover, the extending brim of the traditional helmet provides increased protection from falling water and/or objects.

It is desirable, therefore, to develop improved protective helmets (for example, traditional style firefighter helmets) and methods of manufacture thereof.

SUMMARY OF THE INVENTION

In one aspect, the present invention provides a protective helmet including a generally dome-shaped section and a brim extending outwardly from a lower portion of the dome-shaped section. In the case of a protective helmet of the present invention having the form of a traditional style firefighter helmet, the rear of the brim can extend outwardly from the bottom of the dome-shaped section further and more generally horizontally (or more closely to horizontally) than the rear brim of a modern style firefighter helmet. The sides of the brim of such a traditional style helmet can curve, slope or angle upward, while the rear of the brim can curve, slope or angle downward to provide a water shed. The dome-shaped section and the brim of the helmets of the present invention are formed from a thermoplastic material. The helmet further includes a brim support in operative connection with at least a portion of the brim. The brim support is formed from a material that is more heat resistant than the thermoplastic material. The brim support is sufficiently rigid to limit deformation of the brim upon exposure to high temperature (for example, exposure for a period of time to a temperature above the heat deflection temperature or above the melting temperature of the thermoplastic material). The brim support material can, for example, have a melting point greater than the melting point of the thermoplastic material (for example, above 500° F.).

In one embodiment, the brim support conforms generally to a perimeter of the brim. The brim support can, for example, extend along a portion of the perimeter of the brim. Preferably, the brim support extends over more than fifty percent (50%) of the perimeter of the brim. In one embodiment, the brim supports extends along the entire perimeter of the brim.

The helmet can further include an edge trim that extends around the brim support and the perimeter of the brim to retain the brim support in operative connection with the brim. The brim support can, for example, be added to the helmet after the helmet is formed. The brim support can alternatively be molded into the brim of the helmet. In one embodiment, the brim support is formed from a metal (for example, steel, aluminum or titanium).

In another aspect, the present invention provides a method of manufacturing a protective helmet, including: molding an outer shell of the helmet from a thermoplastic material, the outer shell comprising a generally dome-shaped portion and an outwardly extending brim, the brim preferably extending outwardly from near the bottom of the dome-shaped section; and operatively connecting a brim support to the brim, the brim support being formed from a material that is more heat resistant than the thermoplastic material.

The brim supports of the present invention enable the manufacture of protective helmets (for example, traditional style firefighter helmets and modern style firefighter helmets) from thermoplastic materials having a lower melting point than would otherwise be possible. The brim supports of the present invention can increase the resistance to deformation of the brims of protective helmets upon exposure of such helmets to high temperatures.

DETAILED DESCRIPTION OF THE INVENTION

Figure 1:
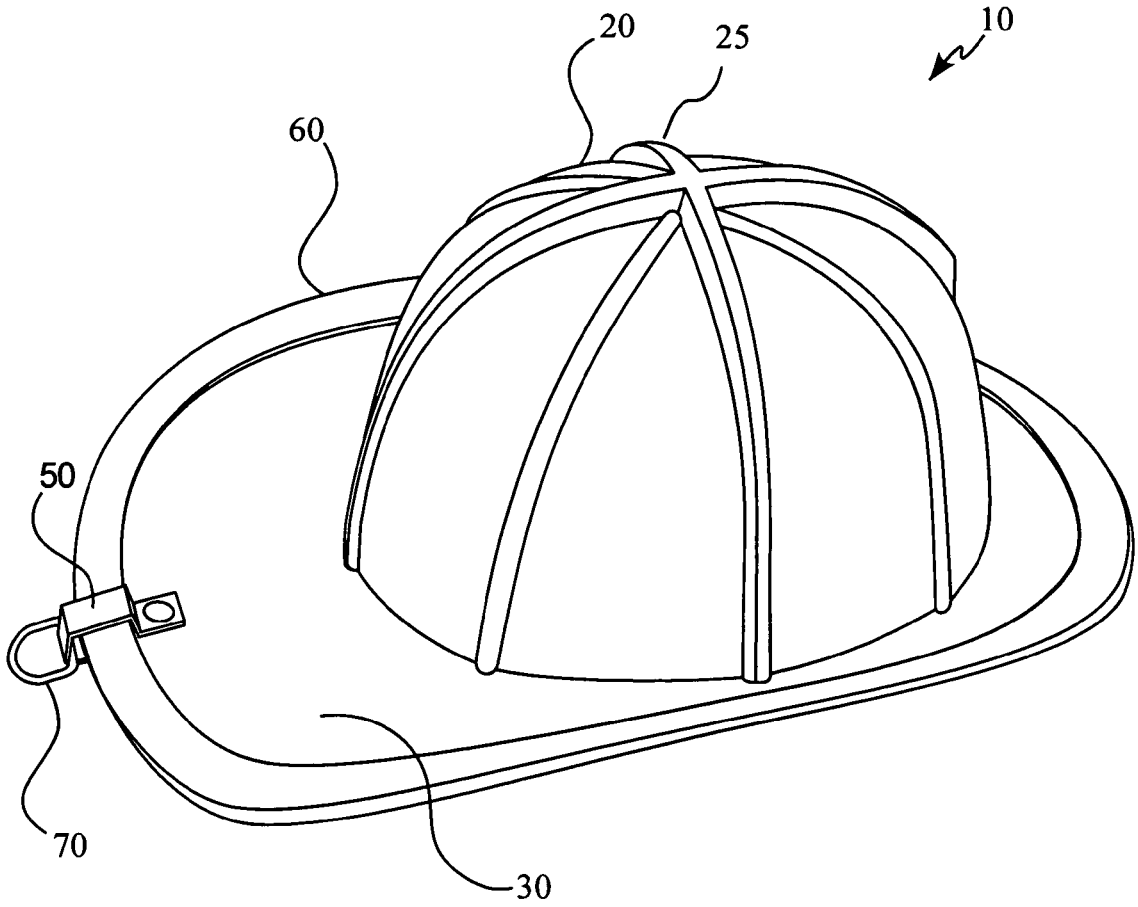
FIG. 1 illustrates a side, perspective view of one embodiment of a firefighter helmet of the present invention having an extending brim associated with a traditional helmet design
Figure 2:
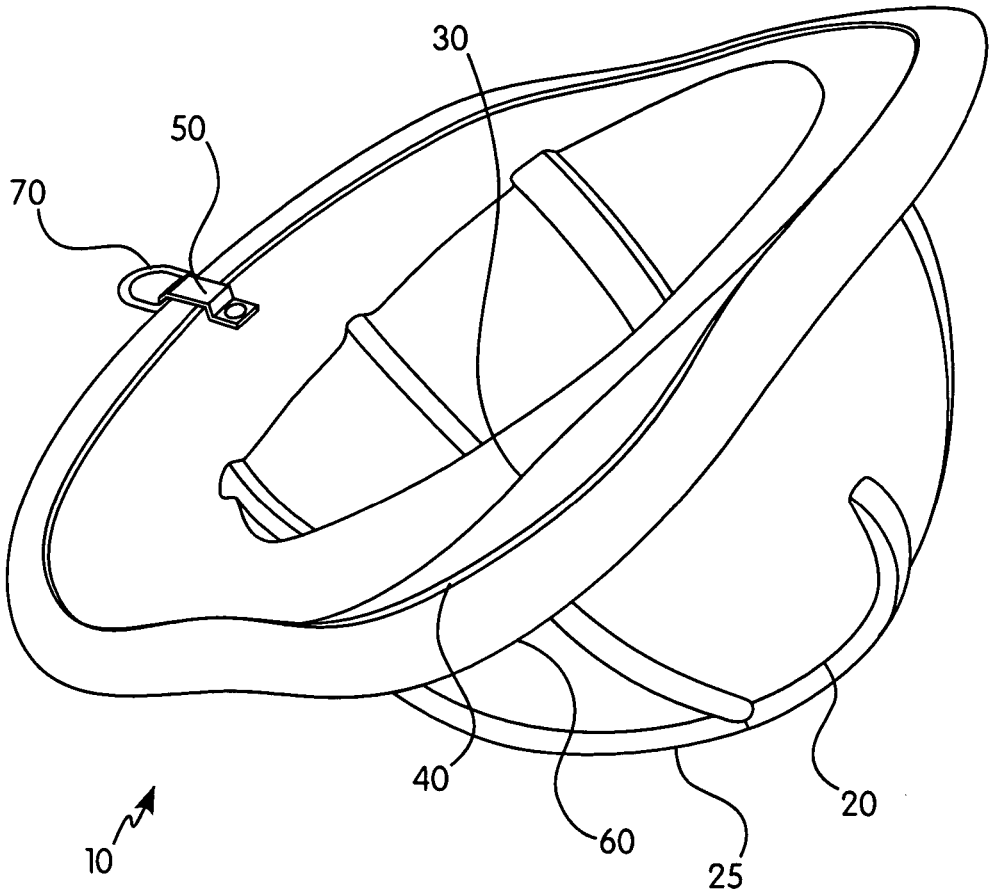
FIG. 2 illustrates a bottom perspective view of the helmet of FIG. 1 wherein the edge trim has been partially removed from connection with the brim to show a portion of the brim support.
Figure 3:
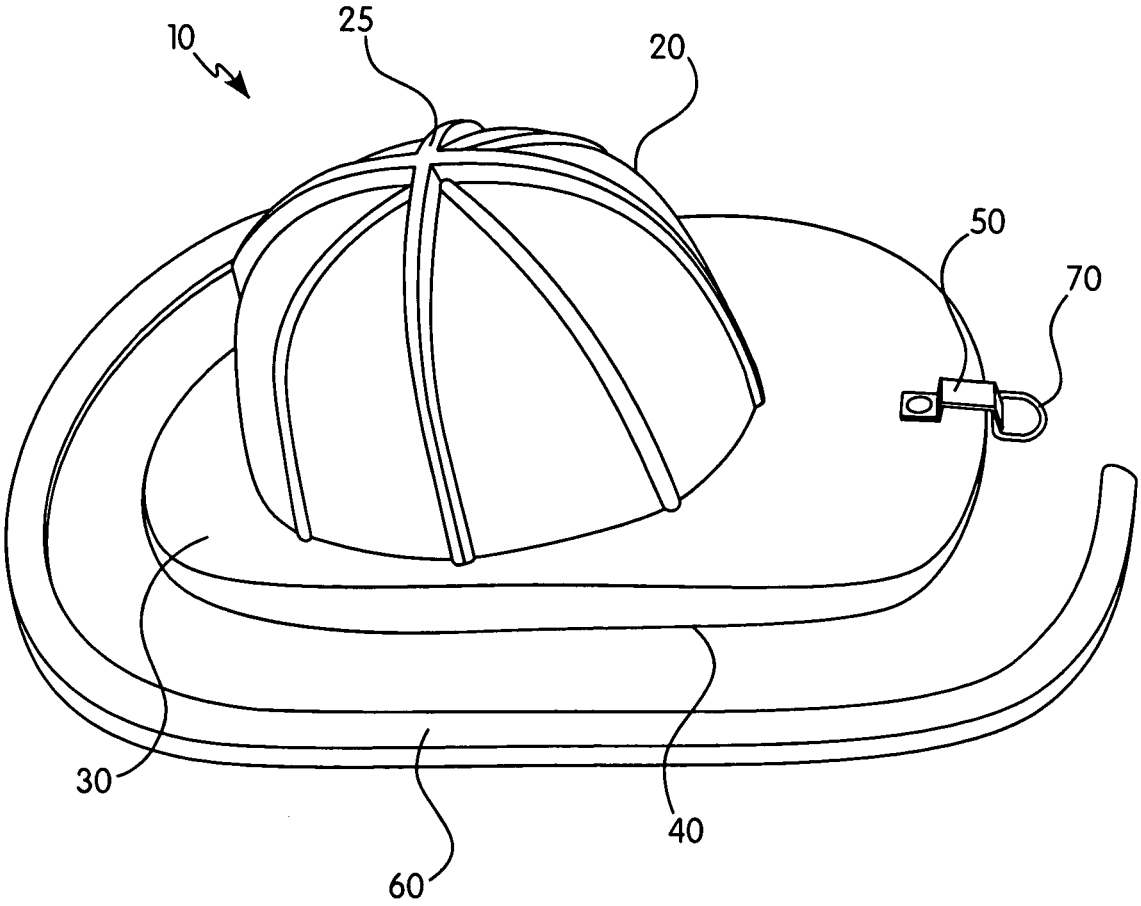
FIG. 3 illustrates a side, perspective view of the helmet of FIG. 1 wherein the edge trim has been removed.

Firefighter's helmets can take a variety of forms as, for example, disclosed in U.S. Pat. Nos. 5,044,016 and 6,260,212, assigned to the assignee of the present invention, the disclosures of which are incorporated herein by reference. FIGS. 1 through 5 illustrate one embodiment of a helmet of the present invention that has the general shape of the CaimsHELMETS® 880 Tradition™ firefighter helmet available from Mine Safety Appliances Company ("MSA"). However, as is clear to one skilled in the art of protective helmets, the protective helmets of the present invention can have generally any shape suitable for protective headgear. Firefighter protective helmet 10 typically includes an outer shell 20. An inner impact attenuation liner assembly (not shown) can be included. Outer shell 20 is formed with a generally dome-shaped section 25 and a radially outward extending brim 30 which can be wider at the back than at the front and at the sides to shield the back of the wearer's neck.

Outer shell 20, dome-shaped section 25 and brim 30 are preferably fabricated from a thermoplastic material exhibiting strength, impact resistance, heat resistance and chemical resistance. An example, of a suitable thermoplastic material for use in the present invention is ULTEM®, available from GE Plastics of General Electric Company Corporation of New York, N.Y. ULTEM is an amorphous thermoplastic polyetherimide providing high heat resistance, high strength, high stiffness and broad chemical resistance.

Upon exposure to an elevated temperature for an extended period of time (for example, to a temperature of 500° F. for five minutes such as is required under the current version of the NFPA 1971 standard), the brim of a helmet fabricated from certain thermoplastic materials can deform. As described above, the NFPA standard limits the amount of deformation a helmet brim can undergo during testing. The present inventor has discovered that inclusion of a brim support 40 around the perimeter of brim 30 significantly limits deformation of brim 30 and enables helmet 10 to fully satisfy the requirement of the current version of the NFPA 1971 standard, even with the extending brim of a traditional helmet design. Brim support 40 can be formed in the general shape of the perimeter of brim 30 and is formed from a heat resistant material. In general, such materials should be sufficiently rigid to support (that is, limit deformation of) brim 30 at high temperature and have a melting temperature above 500° F. Such materials include, but are not limited to various metals, polymers and ceramics. In the embodiment of FIGS. 1 through 5, brim support 40 is fabricated from a metal such as steel. Steel, for example, is quite malleable and can be readily formed in the shape of the perimeter of brim 30.

Brim support 40 can, for example, be in the form of a wire having a structural weight of approximately 1 oz. to approximately 3 oz in the case of a steel wire. In the case of an aluminum wire, the structural weight of brim support 40 can, for example, be in the range of approximately 0.33 oz. to approximately 1 oz. As is clear to one skilled in the art, various structural weights for various other structural materials (for example, titanium, ceramic, etc.) are suitable for use in the present invention.

In one embodiment, brim 30 of helmet 10 (a traditional style helmet similar to the CaimsHELMETS 880 TRADITION® helmet available from MSA) extended outwardly near the bottom of shell 20 approximately 1.75 in. in the front, approximately 1.25 in. on the sides and approximately 3.5 in. at the back of helmet 10. The weight of brim 40 in this embodiment was approximately 193 grams or approximately 6.8 oz. In this embodiment, brim 30 had an overall length (that is, a measurement from front to back) of approximately 15.25 in, and an overall width (that is, a measurement from side to side) of approximately 11.5 in. For comparison, a modern style helmet such as the PHOENIX 660® helmet available from MSA, the brim had an overall length of approximately 14 in. and an overall width of approximately 10.5 in. The brim of that helmet extended away from the shell by approximately 1 in. on the front and sides and by approximately 2.5 in. at the rear of the helmet. In the case of the modern style helmet, the rear of the brim also extends away from the bottom of the dome-shaped section of the shell at approximately a 45° angle downward, whereas the rear brim of traditional style helmet 10 extended generally horizontally from the bottom of the dome-shaped section of shell 20 and curved gently downward near the perimeter of brim 30. The greater extension of the brim of a traditional style helmet and the generally horizontal extension of brim 30 of such helmets from near the bottom of dome-shaped section 25 can result in greater torque and potentially lead to greater deformation of the brim as compared to a modern style helmet upon exposure to temperatures above the heat deflection temperature or above the glass transition temperature of the thermoplastic material of the helmet for an extended period of time.

As recognized by one skilled in the art, the stiffness, shape, dimensions, etc. of brim support 40 can vary widely depending upon the specific properties of the material chosen for brim support 40, the brim conformation, and the specific properties of the thermoplastic material of helmet 10. Typical stiffness values measured for one half of the space-frame width or length of brim support 40 can, for example, be in the range of approximately 1 lbs./in. to approximately 10 lbs./in. (or even approximately 1 lbs./in. to approximately 5 lbs./in.). A variety of combinations of material, diameter and cross-section shape can, for example, create an infinite combination of suitable stiffness along each of the three axes. In the representative embodiment of a steel brim support 40 of a generally circular cross-section, the diameter of brim support 40 can, for example, be in the range of approximately 0.032 in to approximately 0.180 in.

Using a fundamental engineering formula for spring force, spring stiffness, and spring deflection according to the formula F=Kx one can readily determine the deflection x of brim 30 using brim support 40 having a known stiffness K. In that regard, F can be defined as the weight of one half of the brim. K can be defined as the stiffness of one half of the space-frame structure or wire of brim support 40. X can be defined as the deflection of brim 40 assuming that thermoplastic brim 40 is "dead weight" and has no structural stiffness. If F=Kx, the deflection x=F/K. For a brim weight (F) of 4 oz. (0.25 lbs.) and a stiffness (K) of 4 lbs./in., deflection x=(0.25 lbs.)/(4 lbs./in.)=0.0625 in (or 1/16 in.).

It is thus demonstrated that even if the thermoplastic material for brim 30 reaches its melting point, brim support 40 is capable of supporting the brim 40 (treated as dead weight, with no structural stiffness) with only 1/16 in deflection at the location of brim support 40, which is below the deformation limits set forth in the current version of the NFPA 1971 Standard (typically 1 3/8 in. to 1 5/8 in.).

A number of thermoplastic materials suitable for use in the present invention have a heat deflection temperature (at 264 psi) in the range of approximately 235° F. to approximately 400° F., and a melting point in the range of approximately 500° F. to approximately 700° F. At temperatures between the heat deflection temperature and the melting temperature, the material may deflect under a load (even under the load of its own weight), but the material has some structural stiffness. Such materials also have an elastic modulus of approximately 100,000 psi to in excess or 500,000 psi depending on material type. Fillers and/or reinforcements can be added to the materials to provide an elastic modulus of approximately 250,000 psi to in excess of 1,000,000 psi depending on the material type as well as filler and/or reinforcement type and percent composition.

Figure 4:
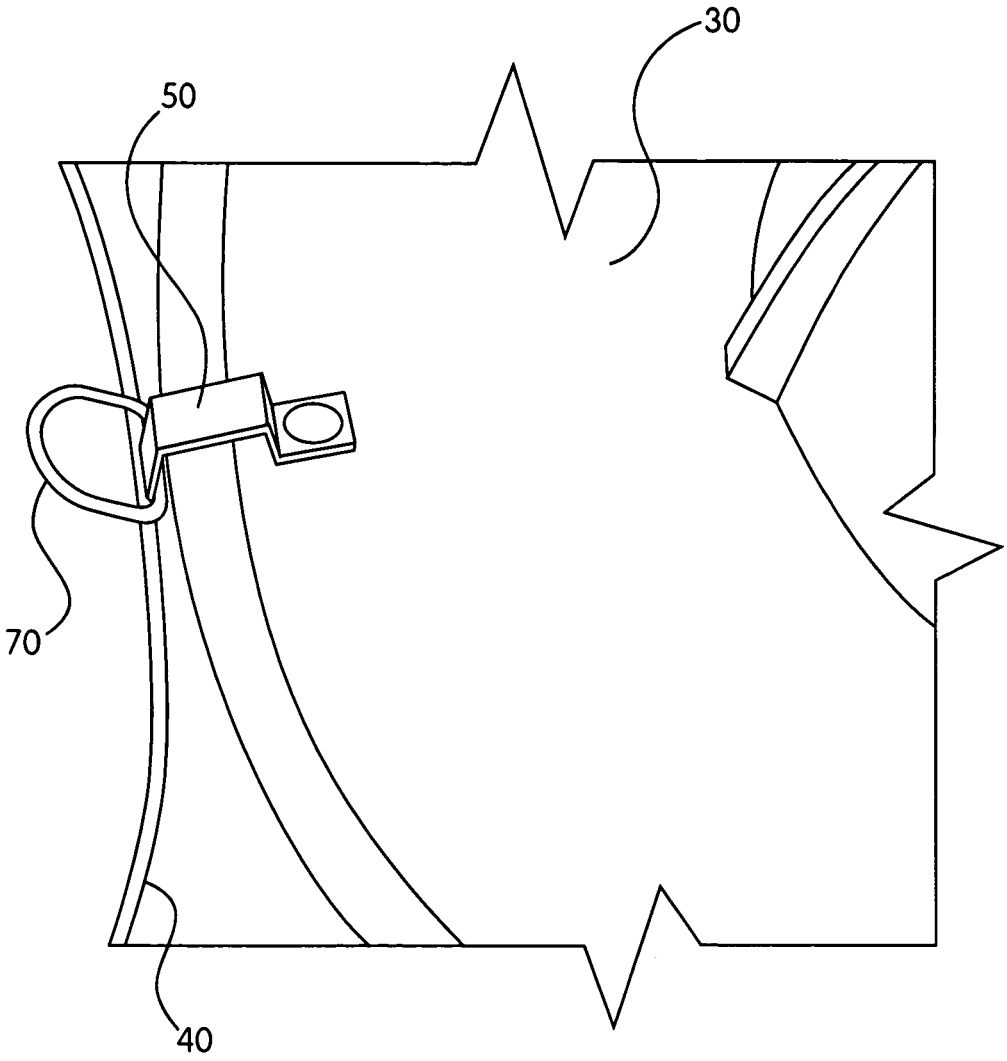
FIG. 4 illustrates a perspective view of a connector used to connect the brim support to the brim of the helmet of FIG. 1.
Figure 5:
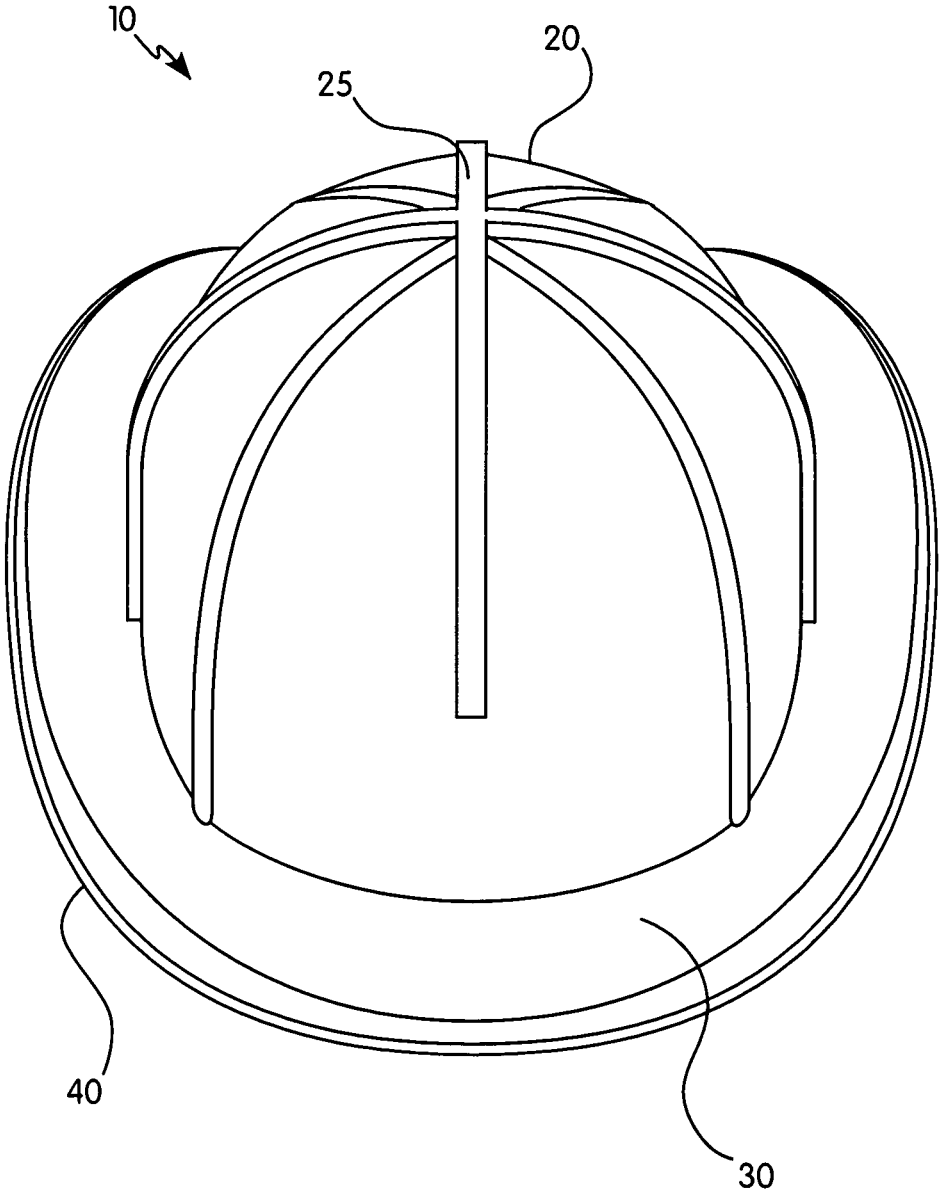
FIG. 5 illustrates a front perspective view of the helmet of FIG. 1 with the edge trim removed.
Figure 6A:
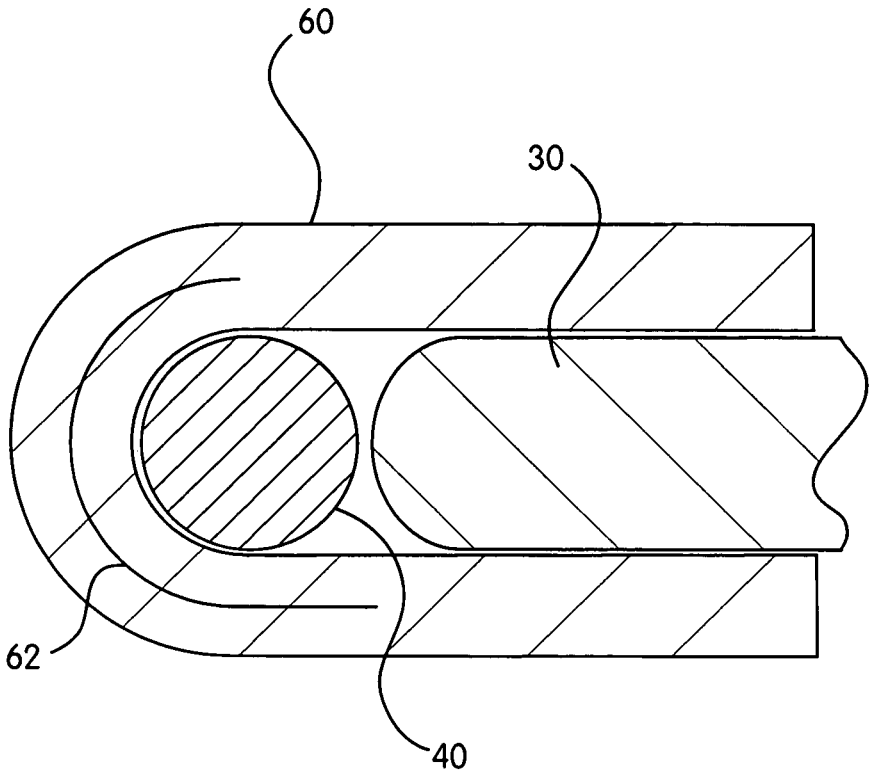
FIG. 6A illustrates a side, cross-sectional view of the operative connection of the edge trim, the brim support and the brim of the helmet of FIG. 1.
Figure 6B:
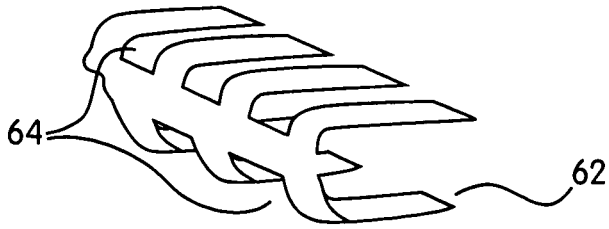
FIG. 6B illustrates a perspective view of a clip member of the edge trim of FIG. 6A.

In the embodiment of FIGS. 1 through 5, brim support 40 is also preferably attached to helmet 10 via a metal clip 50 at the rear of helmet 10 (see, for example, FIG. 4). Brim support 40 is retained in position around the perimeter of brim 30 via an elastomeric or resilient edge trim 60, which can, for example, be formed from a heat resistant thermoplastic rubber. As illustrated in FIGS. 6A and 6B, edge trim 60 can have a generally U-shaped cross section that fits snugly around brim 30 to retain brim support 40 in position adjacent to and around the perimeter of brim 30. Edge trim 60 can, for example, include a clip 62 having a generally U-shaped cross-section. Such metallic clips are sometimes used in edge trim of currently available helmets to maintain the edge trim in snug connection with the brim of the helmet without the use of adhesives. However, the structural stiffness of such clips is compromised by open or cutout sections 64 formed therein to facilitate bending of clip 62 to the shape of the perimeter of the helmet, thereby making such clips unsuitable for use as brim support 40 of the present invention. However, brim support 40 can be formed in the shape of clip 62 as long as the structural stiffness is made sufficient to adequately support brim 30 as described above. For example, open sections 64 can be of reduced width and/or length, provided in reduced number or eliminated. As is clear to one skilled in the art, existing thermoplastic protective helmets are readily retrofitted with the brim support of the present invention to greatly improve the heat resistance of the brim of such helmets.

Figure 7:
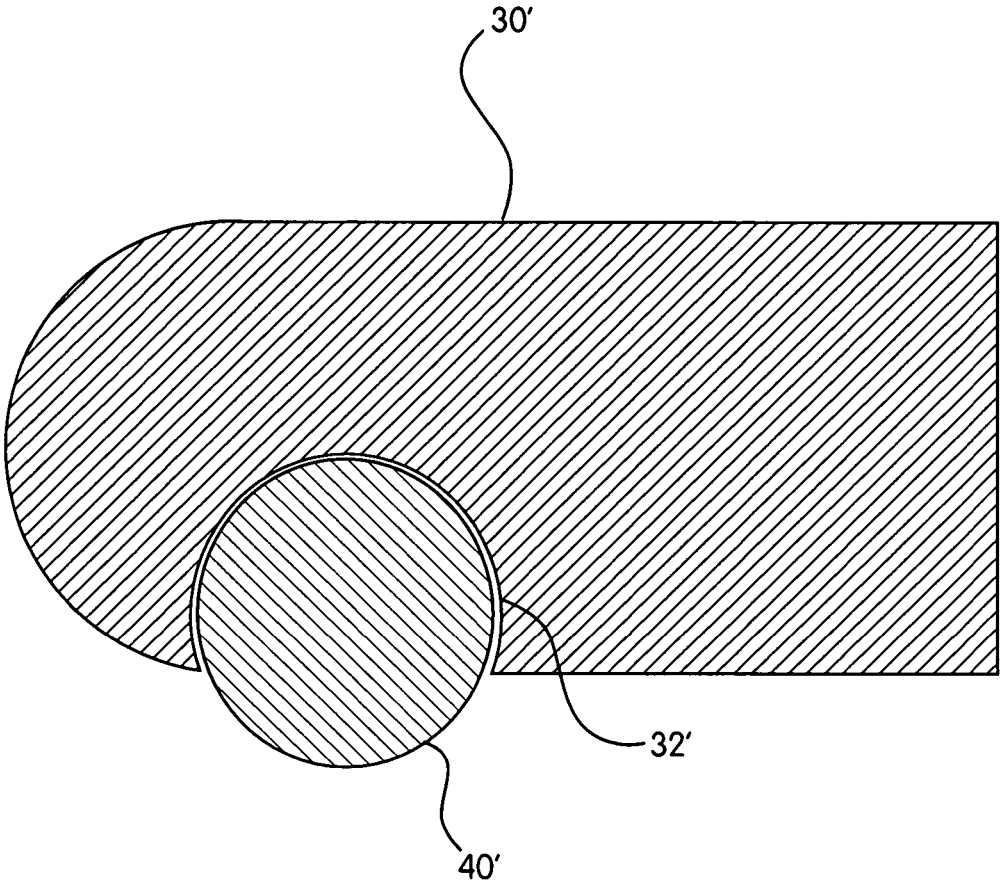
FIG. 7 FIG. 7 illustrates a side cross-sectional view of a portion of another embodiment of a helmet brim of the present invention including a seating into which a brim support can be snap fit.
Figure 8:
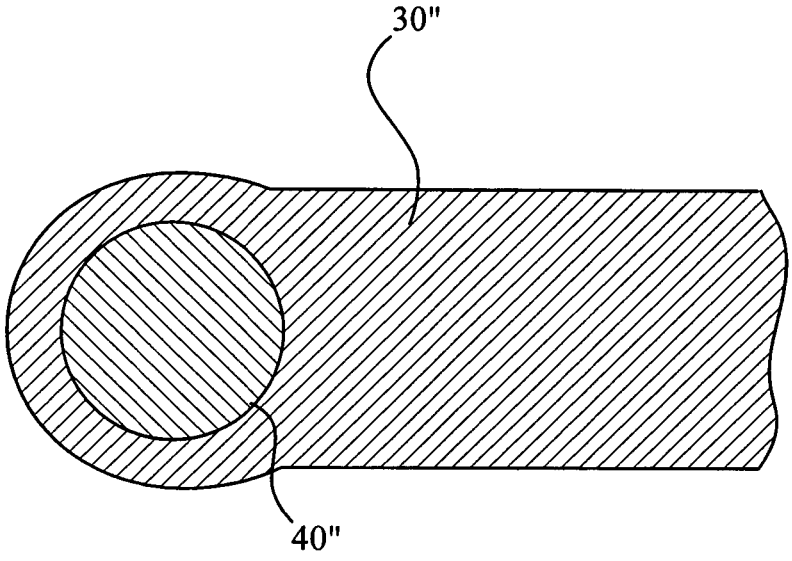
FIG. 8 illustrates another embodiment of a portion of a thermoplastic helmet brim of the present invention wherein the brim support is molded into the brim.

FIG. 7 illustrates another embodiment of a helmet brim 30' including a seating 32' into which a brim support 40' can be snap fit, thereby potentially eliminating the need for a separate attachment member (such as edge trim 60) to maintain brim support 40 in operative connection with brim 30'. Adhesives and other attachment mechanisms can also be used to maintain the brim supports of the present invention in operative connection with the helmet brims thereof. FIG. 8 illustrates another embodiment of a helmet brim 30" of the present invention in which a brim support 40" has been molded within brim 30".

The foregoing description and accompanying drawings set forth preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

What is claimed is:

1. A protective helmet comprising:

an outer shell comprising a generally dome-shaped section;

a brim extending outwardly from the dome-shaped section by at least 2.5 inches at the rear of the helmet, the dome-shaped section and the brim consisting essentially of a thermoplastic material having a heat deflection temperature at 264 psi in the range of approximately 235° F. to approximately 400° F., and a melting point of at least 500° F.;

a brim support placed adjacent the brim after formation thereof and extending adjacent at least a portion of the brim; the brim support comprising a material that is more heat resistant than the thermoplastic material and is sufficiently rigid to limit deformation of the brim upon exposure to high temperature such that the protective helmet satisfies the National Fire Protection Association 1971 standard; and an edge trim formed of a resilient material that extends around the brim support and the perimeter of the brim to encompass the brim support and retain the brim support in operative connection with the brim.

2. The helmet of claim 1 wherein the brim support extends adjacent the entire brim.

3. The helmet of claim 2 wherein the brim support material has a melting point in the range of 500° F. to approximately 700° F.

4. The helmet of claim 3 wherein the brim support conforms generally to a perimeter of the brim.

5. The helmet of claim 4 wherein the brim supports extends along a portion of the perimeter of the brim.

6. The helmet of claim 4 wherein the brim supports extends along the entire perimeter of the brim.

7. The helmet of claim 1 wherein the edge trim is formed from an elastomeric material.

8. The helmet of claim 7 wherein the edge trim has a generally U-shaped cross-section which fits around the brim support and the perimeter of the brim.

9. The helmet of claim 8 wherein the edge trim is formed from a heat resistant thermoplastic rubber.

10. The helmet of claim 1 wherein the brim support is formed from a metal.

11. A protective helmet comprising:

an outershell comprising a generally dome-shaped section;

a brim extending outwardly from the dome-shaped section by at least 2.5 inches at the rear of the helmet, the dome-shaped section and the brim consisting essentially of a thermoplastic material that is molded to form the dome-shaped section and the brim;

a brim support placed adjacent the brim after formation thereof; the brim support being formed from a material that is more heat resistant than the thermoplastic material and being sufficiently rigid to limit deformation of the brim upon exposure to high temperature such that the protective helmet satisfies the National Fire Protection Association 1971 standard; and an edge trim formed of a resilient material that extends around the brim support and the perimeter of the brim to encompass the brim support and retain the brim support in operative connection with the brim.

12. The helmet of claim 11 wherein the brim support extends adjacent the entire brim.

13. The helmet of claim 12 wherein the brim support material has a melting point above 500 F.

14. The helmet of claim 13 wherein the brim support conforms generally to a perimeter of the brim.

15. The helmet of claim 14 wherein the brim support extends adjacent a portion of the perimeter of the brim.

16. The helmet of claim 15 wherein the brim support extends adjacent the entire perimeter of the brim.

17. The helmet of claim 16 wherein the edge trim is formed form an elastomeric material.

18. The helmet of claim 17 wherein the edge trim has a generally U-shaped cross-section which fits around the brim support and the perimeter of the brim.

19. The helmet of claim 17 wherein the edge trim is formed from a heat resistant thermoplastic rubber.

20. The helmet of claim 11 wherein the brim support is formed from a metal.

21. The helmet of claim 18 wherein the edge trim comprises at least one U-shaped metallic support.

22. The helmet of claim 21 wherein the edge trim comprises a plurality of U-shaped metallic supports.

23. The helmet of claim 21 wherein the edge trim is formed from a heat resistant thermoplastic rubber.

24. The helmet of claim 21 wherein the brim extends generally horizontally from the dome at the rear of the helmet over at least a portion of the width of the brim.

25. The helmet of claim 8 wherein the edge trim comprises at least one U-shaped metallic support.

26. The helmet of claim 25 wherein the edge trim comprises a plurality of U-shaped metallic supports.

27. The helmet of claim 1 wherein the brim consists of the thermoplastic material.

28. The helmet of claim 11 wherein the brim consists of the thermoplastic material.

* * * * *